US006578831B2

(12) United States Patent
Menzel et al.

(10) Patent No.: US 6,578,831 B2
(45) Date of Patent: Jun. 17, 2003

(54) CARBURETOR ARRANGEMENT

(75) Inventors: Johannes Menzel, Stuttgart (DE); Roland Adam, Besigheim (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/058,798

(22) Filed: Jan. 30, 2002

(65) Prior Publication Data

US 2002/0105101 A1 Aug. 8, 2002

(30) Foreign Application Priority Data

Feb. 2, 2001 (DE) ..... 201 02 026

(51) Int. Cl.[7] ..... F02M 15/06

(52) U.S. Cl. ..... 261/152; 55/DIG. 28; 123/198 E; 261/156; 261/DIG. 81

(58) Field of Search ..... 261/35, 152, 156, 261/DIG. 19, DIG. 81; 55/385.3, DIG. 28; 123/198 E

(56) References Cited

U.S. PATENT DOCUMENTS 1,207,664 A * 12/1916 Thurston ..... 165/52
1,740,221 A * 12/1929 Boulade ..... 261/152
1,874,587 A * 8/1932 Niven ..... 96/383
2,460,528 A * 2/1949 Oswald ..... 261/134
2,879,045 A * 3/1959 Russell ..... 261/144
3,672,342 A * 6/1972 Ojala ..... 123/538
4,594,083 A * 6/1986 Hiraizumi ..... 55/385.3
4,716,878 A * 1/1988 Shimada et al. ..... 123/540
5,073,307 A * 12/1991 Langer et al. ..... 261/35
5,743,240 A * 4/1998 Zerrer et al. ..... 123/518
6,287,354 B1 * 9/2001 Nozaki ..... 55/385.3
6,293,981 B1 * 9/2001 Holderle et al. ..... 55/318
6,395,049 B2 * 5/2002 Knodler et al. ..... 55/385.3

* cited by examiner

*Primary Examiner*—Richard L. Chiesa
(74) *Attorney, Agent, or Firm*—Walter Ottesen

(57) ABSTRACT

The invention is directed to a carburetor arrangement in a housing (1) and especially in the housing of a work apparatus such as a motor-driven chain saw or like portable handheld work apparatus. An engine (2) is mounted in the housing (1) and has an inlet channel (3) which is connected via a connecting pipe (4) to the intake channel section (5) of a membrane carburetor (6). An intake air filter (10) is mounted on the carburetor (6) on the end face (17) facing away from the connecting pipe (4). Combustion air is supplied through the intake air filter (10). To avoid a damaging warming of the carburetor, a heat-draining component (20) is mounted on the end face (17) of the carburetor which faces away from the connecting pipe (4). The component (20) projects beyond the contour of the carburetor (6).

22 Claims, 3 Drawing Sheets

CARBURETOR ARRANGEMENT

FIELD OF THE INVENTION

The invention relates to a carburetor arrangement in a housing including the housing of a work apparatus such as a motor-driven chain saw, brushcutter or the like.

BACKGROUND OF THE INVENTION

Known carburetor arrangements are built up in such a way that the carburetor with an intake air filter is attached to a housing partition wall which is arranged between the internal combustion engine and a carburetor space. In this way, a too intense heating of the carburetor is intended to be countered. The connection between the carburetor and the inlet channel of the engine is via a connecting pipe which, for example, can be configured as an elastic connecting stub. The connecting pipe is mostly made of a material having a poor thermal conductivity in order to prevent a thermal bridging as much as possible. Notwithstanding the known measures, a damaging heating of the carburetor cannot be completely precluded under unfavorable operating conditions because of the ever smaller and tighter housings. However, if the carburetor becomes too hot, this can lead to the formation of vapor bubbles which negatively affect the operation of the engine. For example, if a work apparatus, which is equipped with an engine, is switched off after an operating cycle, the carburetor can warm to the point where vapor bubbles are formed thereby greatly hindering a restart of the engine.

SUMMARY OF THE INVENTION

It is an object of the invention to provide a carburetor arrangement of the kind described above which is improved so that a damaging warming of the carburetor is reliably avoided during operation of the engine as well as after an operating cycle.

The carburetor arrangement of the invention is disposed in a housing accommodating an internal combustion engine having an inlet channel. The carburetor arrangement includes: a carburetor defining an intake channel; a connecting pipe connecting the inlet channel of the engine to the intake channel of the carburetor; the carburetor having a front end facing away from the connecting pipe; an air filter assembly for supplying combustion air to the engine; the carburetor having a contour and being connected to the air filter assembly at the front end; and, a heat-draining component mounted on the front end and projecting beyond the contour.

By mounting the heat-draining component at a location lying remote from the engine, a significant quantity of heat can be conducted away via a thermal-conducting contact with the carburetor so that a damaging warming of the carburetor itself is avoided. The heat-draining component projects beyond the contour of the carburetor so that these sections, which project beyond the contour, can give off heat advantageously on both sides over a large area. In this way, a cooling body is provided with which a formation of vapor bubbles in the carburetor can be reliably avoided even under unfavorable conditions.

Preferably, the heat-draining component is mounted on an end face of the carburetor and is especially clamped between the carburetor and the air filter case. In this way, a heat-conducting contact to the heat-draining component is established on the entire end face of the carburetor in order to achieve a large-area thermal transfer into the cooling body. This cooling body is preferably configured to be three-dimensional so that every possibility for conducting heat away in all axial directions of the space can be utilized.

It is practical to configure the heat-draining component so that a bent-over, wing-shaped cooling flange lies at a lateral distance next to the carburetor. In this way, also the dead spaces can be utilized for cooling the carburetor itself. The cooling flange lies advantageously in a space between the carburetor and the air filter case and is preferably at a spacing to the air filter case.

In a further embodiment of the invention, the heat-draining component is provided with a receiving pocket which engages under a housing section of the air filter case. The housing section of the air filter case lies essentially without play in the receiving pocket in the direction of the longitudinal center axis of the carburetor. The end wall of the receiving pocket is preferably attached to the housing section of the air filter case. In this way, the heat-draining component and the air filter case are connected to an assembly component utilized together. It can also be advantageous that the heat-draining component be placed in the injection mold of the air filter case manufactured usually of plastic so that the heat-draining component is fixedly connected to the air filter case.

In a preferred embodiment of the invention, the heat-draining component is made of heat-draining sheet metal and this sheet metal is preferably bent over several times. In a first manufacturing step, a sheet metal plate can be punched. With the stamping operation, not only the outer contour of the heat-draining component can be determined but, simultaneously, the openings can be introduced which are necessary for the attachment and the intake air flow. After this premanufacture of the sheet metal plate, the plate is bent over, for example, at only three bending lines in order to obtain, as an end product, a three-dimensional heat-draining component for arrangement between the air filter case and a carburetor.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
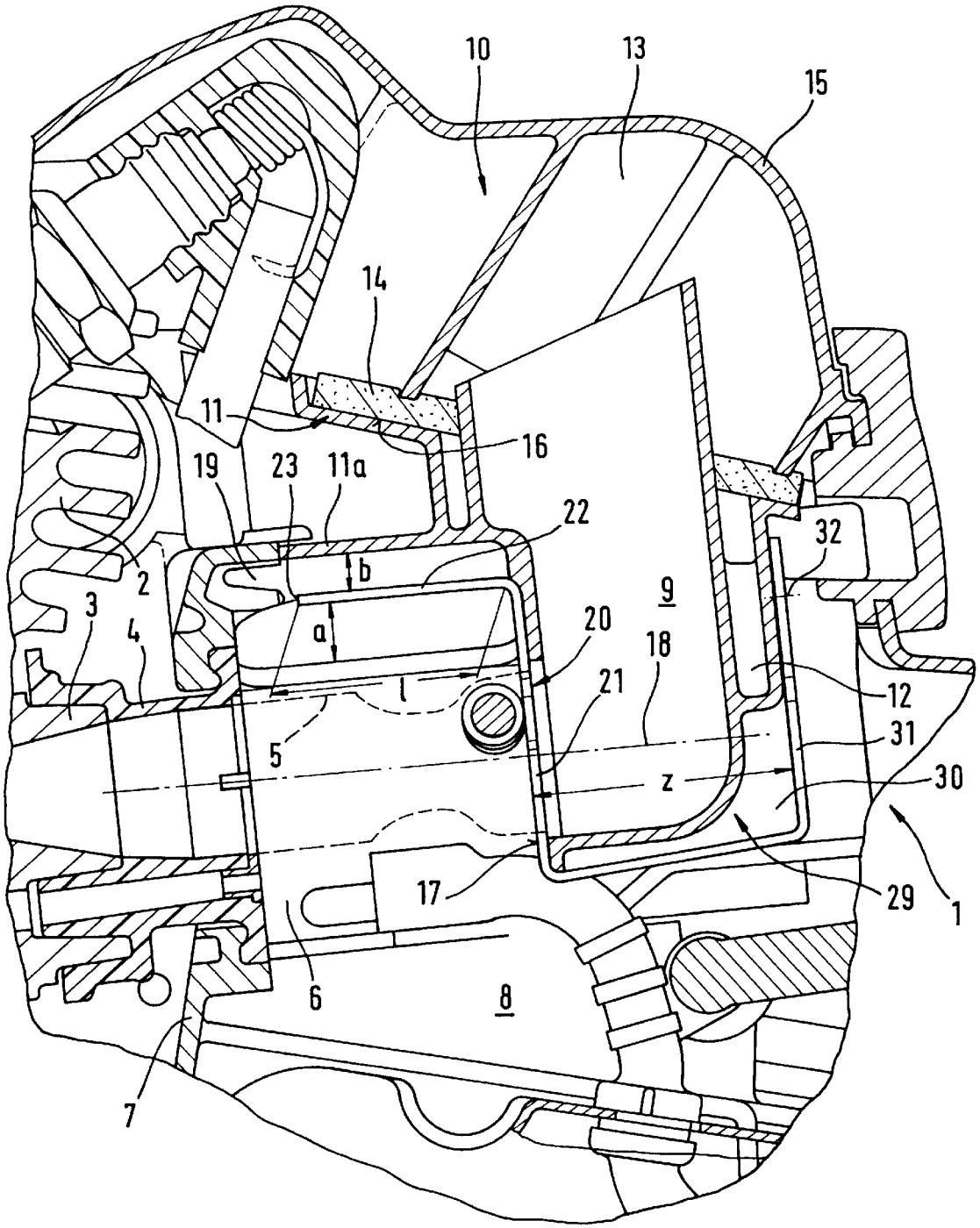
FIG. 1 is a section view through a carburetor arrangement in the housing 1 of the work apparatus in accordance with an embodiment of the invention.

The carburetor arrangement, which is shown in section in FIG. 1, is mounted in a housing and especially in a housing of a work apparatus such as a portable handheld work apparatus. The work apparatus can, for example, be a motor-driven chain saw, a brushcutter, a cutoff machine, a hedge trimmer or the like. An internal combustion engine 2 is mounted in the housing 1 and has an inlet channel 3 connected via a connecting pipe 4 to the intake channel section 5 of a carburetor 6. The carburetor 6 is held on the partition wall 7 by stud bolts (not shown). The partition wall 7 separates the engine 2 from a carburetor space 8. In the embodiment shown, the connecting pipe 4 is configured as a flexible connecting stub which, simultaneously, ensures a decoupling of the carburetor 6 from the engine 2 with respect to vibration and heat.

On the end, which faces away from the connecting pipe 4, the carburetor is connected to the intake pipe 9 of an intake air filter 10. The intake pipe 9 forms a part of the air filter case 11 and passes through the contamination space 12 so that the clean air side 13 communicates with the intake channel section 5. The filter element 14 is mounted between the contamination space 12 and the clean space 13 and the inducted combustion air flows therethrough. A removable housing cover 15 holds the filter element 14 on the support 16 of the air filter case 11.

In order to hold a possibly occurring disadvantageous warming of the housing of the carburetor 6 to a low level, a component 20 for conducting away heat is mounted on the end face 17 of the carburetor facing away from the connecting pipe 4. The housing of the carburetor 6 is usually made of metal. This component 20 projects beyond the contour of the carburetor 6 and an attachment section 21 of the component 20 is preferably clamped at the end face 17 of the carburetor 6.

The heat-draining component 20 is preferably configured to be three dimensional and includes at least one bent-over, wing-like cooling flange 22 which extends at a lateral distance (a) next to the carburetor 6. The cooling flange 22 especially lies parallel to the longitudinal center axis 18 of the carburetor 6.

The cooling flange 22 is configured as a sheet metal section and lies in a space 19 between the air filter case base 11*a* and the housing of the carburetor 6. The cooling flange 22 not only lies at a spacing (a) to the housing of the carburetor 6, but also at a distance (b) to the air filter case base 11*a*. The length L of the cooling flange is preferably shorter than the length of the carburetor measured in the direction of the longitudinal center axis 18 so that the free end edge 23 of the cooling flange 22 ends at a distance ahead of the partition wall 7. It can be practical to configure the cooling flange 22 so that it butts up against the partition wall 7 in order to make available a maximum cooling surface.

The three-dimensional component 20 further includes a receiving pocket 30 which is configured in the direction of the longitudinal center axis 18 of the carburetor 6 between the attachment section 21 and a forward end wall 31. The receiving pocket 30 engages underneath an end-projecting housing section 29 of the air filter case 11. The housing section 29 is formed essentially by the intake pipe 9 which connects the clean space 13 to the intake channel section 5.

The housing section 29 lies essentially without play in the receiving pocket 30 in the direction of the longitudinal center axis 18. The end wall 31 lies at a distance (z) to the end wall 17 and is attached to the in-projecting section 29. This attachment can be with rivets or threaded fasteners which pass through corresponding attachment openings 32 in the end wall 31. The air filter case 11 and the heat-draining component 20 are connected to form a common component which is to be assembled as an assembly component in the housing.

Figure 4:
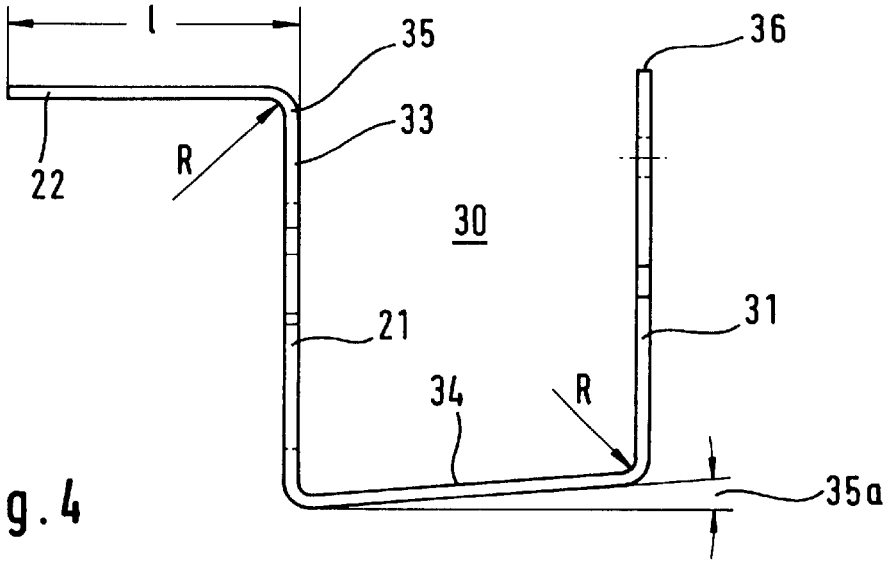
FIG. 4 is a section view through the heat-draining component of FIG. 2; and, FIG. 5 is a plan view of a sheet metal plate for forming the heat-draining component of FIGS. 2 to 4.

As shown in the section views of FIGS. 1 and 4, the attachment section 21 is part of a rear wall 33 of the receiving pocket 30. The rear wall 33 lies in the plane between the air filter case 11 and the carburetor 6 and carries the cooling flange 22 at its free edge 35 facing away from the base 34 of the receiving pocket 30. The cooling flange 22 lies approximately at a right angle to the rear wall 33.

The forward end wall 31 extends approximately up to the elevation of the cooling flange 22. The end wall 31 corresponds approximately in its height to the height of the end wall 33. The base 34 runs from the rear wall 33 to the forward end wall 31 in the direction of the longitudinal center axis 18 of the carburetor 6 at an angle 35*a* of preferably approximately 5° inclined upwardly. In this way, for the same height of the rear wall 33 and the end wall 31, the free upper edge 36 of the end wall 31 lies slightly higher than the cooling flange 22.

In the rear wall 33, an opening 37 having the diameter D (FIG. 5) lies centrally in the attachment section 21. The size of the opening 37 is adapted to the cross section of the intake channel section 5. In addition to the flow opening 37, attachment openings 38 are formed which are provided so that stud bolts can pass through for attaching the air filter case 11 together with the carburetor 6 on the partition wall 7. In order to provide an access for the stud bolts for assembly, a cutout 28 as well as a passthrough opening 39 of suitable size are provided in the forward end wall 31.

Figure 2:
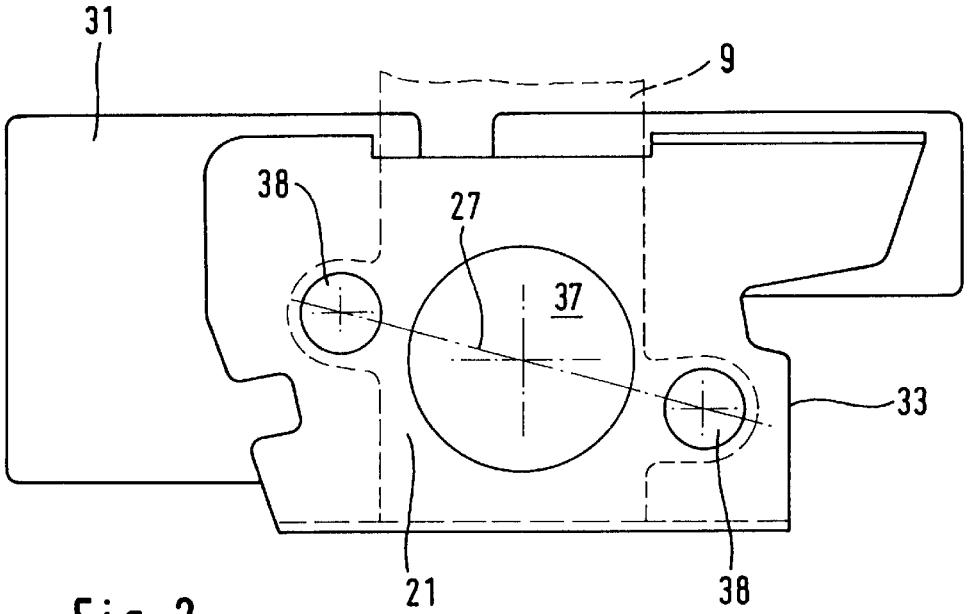
FIG. 2 is a view of a heat-draining component seen from the direction of the carburetor.
Figure 3:
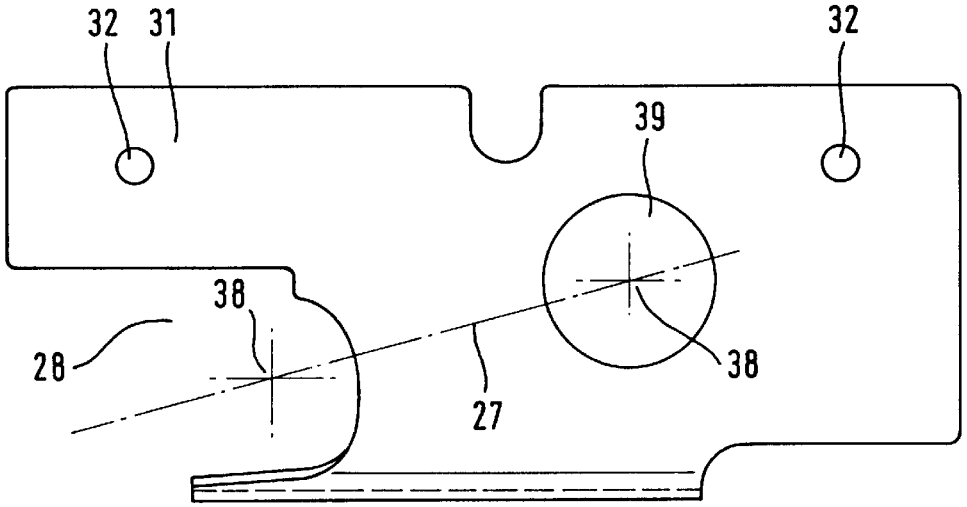
FIG. 3 is a view of the heat-draining component of FIG. 2 from the opposite direction.

In FIGS. 2 and 3, a connecting line 27 is shown between the center points of the attachment openings 38. The rear wall 33 forms an additional reinforcement of the air filter case 11 in the region whereat the force of the stud bolts is introduced. The stud bolts are threaded into the attachment openings 38 and the air filter case 11 usually is made of plastic.

As shown in FIG. 2, the housing section 29 of the air filter case has, in the region of the intake pipe, a lesser width than the walls 31 and 33 of the heat-draining component. The back wall 33 projects laterally beyond the end wall 17 of the carburetor. The forward end wall 31 is configured wider than the back wall and so has sections, which stand free in the space, and this is advantageous for conducting heat away.

Figure 5:
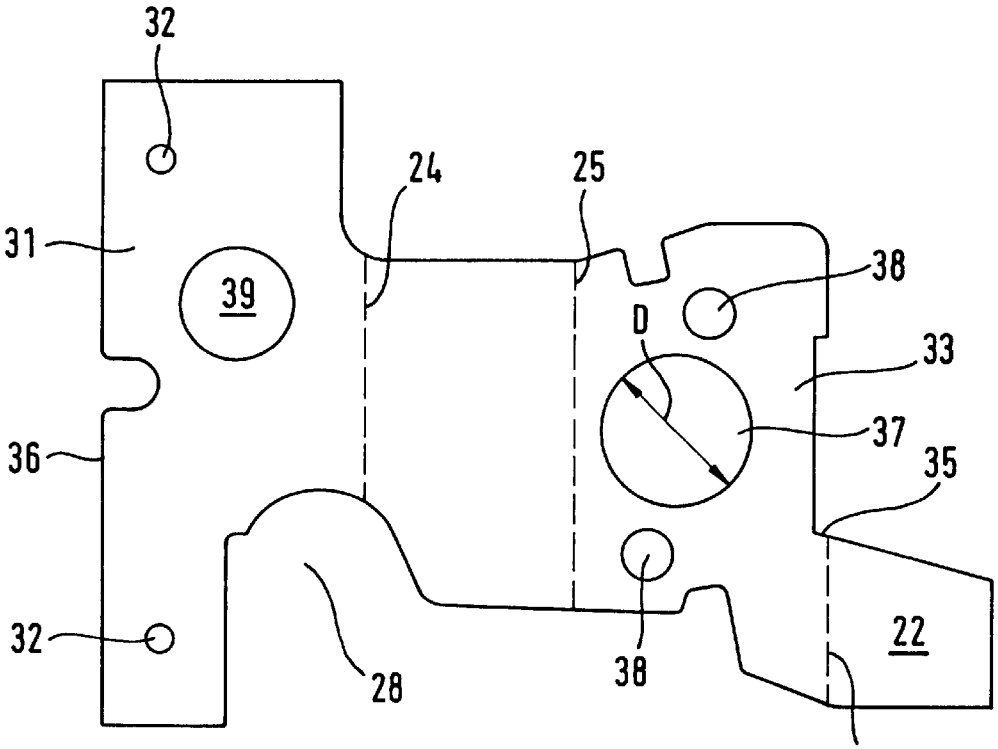

As shown in FIGS. 2 to 5, the heat-draining component is preferably made of sheet metal and especially from a sheet metal plate bent several times. In FIG. 5, a sheet metal plate is shown before bending. The starting body is bent over at right angles at the bending lines 24, 25, 26 and the bending radii R are maintained as shown in FIG. 4.

The cooling flange 22 is configured as a wing-like sheet metal section and lies laterally offset to the intake opening 37 in the rear wall 33. The cooling flange 22 is preferably caressed by a component flow of the cooling air flow of the air-cooled engine. The engine can be a two-stroke engine, a mixture-lubricated four-stroke engine or even a sump-lubricated four-stroke engine.

FIG. 5 shows that the rear wall 33 is approximately half the width of the forward end wall 31. In the configuration of the component from heat-draining sheet metal, all attachment openings (32, 38) as well as openings 37 and 39 and breakout 28 and the remaining form are produced in a simple manner by stamping. The component is finished for assembly on the air filter case 11 after a bending operation for bending over at the bending lines 24, 25 and 26.

It is understood that the foregoing description is that of the preferred embodiments of the invention and that various changes and modifications may be made thereto without departing from the spirit and scope of the invention as defined in the appended claims.

What is claimed is:

1. A carburetor arrangement in a housing accommodating an internal combustion engine having an inlet channel, the carburetor arrangement comprising:

a carburetor defining an intake channel;

a connecting pipe connecting said inlet channel of said engine to said intake channel of said carburetor;

said carburetor having a front end facing away from said connecting pipe;

an air filter assembly for supplying combustion air to said engine;

said carburetor having a contour and being connected to said air filter assembly at said front end; and, a heat-draining component mounted on said front end and projecting beyond said contour.

2. The carburetor arrangement of claim 1, wherein said component lies in surface contact engagement on said front end of said carburetor.

3. The carburetor arrangement of claim 1, wherein said component is configured so as to be three dimensional.

4. The carburetor arrangement of claim 1, wherein said air filter assembly includes an air filter case and said air filter case and said heat-draining component are connected to define a unitary assembly unit.

5. The carburetor arrangement of claim 4, said heat-draining component being clamped between said carburetor and said air filter case.

6. The carburetor arrangement of claim 5, said heat-draining component having a bent-over, wing-shaped cooling flange formed thereon; and, said cooling flange extending at a lateral distance (a) next to said carburetor.

7. The carburetor arrangement of claim 6, said carburetor defining a longitudinal center axis and said cooling flange extending approximately parallel to said longitudinal center axis.

8. The carburetor arrangement of claim 7, said carburetor and said air filter case conjointly defining a space therebetween and said cooling flange being disposed in said space between said carburetor and said air filter case.

9. The carburetor arrangement of claim 8, wherein said air filter case has a base and said cooling flange is at a distance (b) from said base.

10. The carburetor arrangement of claim 8, wherein said air filter case has a housing; and, said heat-draining component has a receiving pocket formed thereon and said receiving pocket accommodates a section of said housing of said air filter case therein.

11. The carburetor arrangement of claim 10, wherein said carburetor defines a longitudinal center axis; and, said section of said housing of said air filter case lies essentially without play in said receiving pocket in the direction of said longitudinal center axis.

12. The carburetor arrangement of claim 11, wherein said heat-draining component has a front wall at a distance (z) from said front end of said carburetor; and, said front wall is fixedly attached to said section of said housing of said air filter case.

13. The carburetor arrangement of claim 12, wherein said heat-draining component also has a rear wall; said front wall is approximately parallel to said rear wall and extends approximately to the height of said cooling flange.

14. The carburetor arrangement of claim 13, wherein said rear wall defines a portion of said receiving pocket and said rear wall lies between said air filter case and said carburetor.

15. The carburetor arrangement of claim 14, wherein said front wall has approximately the height of said rear wall.

16. The carburetor arrangement of claim 15, wherein said front wall is wider than said rear wall.

17. The carburetor arrangement of claim 13, wherein said cooling flange extends from the upper edge of said rear wall.

18. The carburetor arrangement of claim 13, wherein said rear wall has an opening formed therein adapted to the cross section of said intake channel.

19. The carburetor arrangement of claim 13, wherein said front wall has an access opening formed therein.

20. The carburetor arrangement of claim 1, wherein said heat-draining component comprises heat-draining sheet metal.

21. The carburetor arrangement of claim 20, wherein said heat-draining sheet metal is bent over a multiple number of times.

22. The carburetor arrangement of claim 1, wherein said housing is a housing of a work apparatus including a motor-driven chain saw and a brushcutter.

* * * * *